US010119539B2

(12) United States Patent
Schweiher et al.

(10) Patent No.: US 10,119,539 B2
(45) Date of Patent: Nov. 6, 2018

(54) INTERNAL-GEAR PUMP AND HYDRAULIC CIRCUIT FOR A MOTOR VEHICLE DRIVETRAIN

(71) Applicant: GETRAG Getriebe- und Zahnradfabrik Hermann Hagenmeyer GmbH & Cie KG, Untergruppenbach (DE)

(72) Inventors: Mark Schweiher, Lauffen (DE); Thomas Hoffmeister, Korntal-Muenchingen (DE); Sven Schuster, Walheim (DE); Holger Berg, Heilbronn (DE)

(73) Assignee: GETRAG Getriebe—und Zahnradfabrik Hermann Hagen, Untergruppenbach (DE)

( * ) Notice: Subject to any disclaimer, the term of this patent is extended or adjusted under 35 U.S.C. 154(b) by 748 days.

(21) Appl. No.: 14/484,682

(22) Filed: Sep. 12, 2014

(65) Prior Publication Data

US 2015/0086403 A1 Mar. 26, 2015

(30) Foreign Application Priority Data

Sep. 20, 2013 (DE) ..... 10 2013 110 400

(51) Int. Cl.
*F04C 14/04* (2006.01)
*F04C 2/10* (2006.01)
(Continued)

(52) U.S. Cl.
CPC ..... *F04C 2/105* (2013.01); *F04C 2/102* (2013.01); *F04C 14/04* (2013.01); *F04C 14/12* (2013.01); *F04C 15/06* (2013.01); *F04C 2/086* (2013.01)

(58) Field of Classification Search
CPC ..... F04C 2/086; F04C 2/102; F04C 2/105; F04C 14/04; F04C 14/12; F04C 15/06
(Continued)

(56) References Cited

U.S. PATENT DOCUMENTS 4,193,746 A 3/1980 Aman, Jr.
4,222,719 A * 9/1980 Johnson ..... F04C 14/04 418/171
(Continued)

FOREIGN PATENT DOCUMENTS

CN 102705227 A 10/2012
CN 102939436 A 2/2013
(Continued)

OTHER PUBLICATIONS

Author: Ahmed A. Omara Title: A pulse-width-modulated flow-control valve Date published (mm/dd/yyyy): May 31, 1992 Date accessed (mm/dd/yyyy): Mar. 5, 2018 Link: https://preserve.lehigh.edu/cgi/viewcontent.cgi?article=1077&context=etd.*
(Continued)

*Primary Examiner* — Kenneth J Hansen
*Assistant Examiner* — Chirag Jariwala
(74) *Attorney, Agent, or Firm* — Reising Ethington P.C.

(57) ABSTRACT

An internal-gear pump has a housing which has a first fluid port and a second fluid port. An inner rotor is mounted in the housing so as to be rotatable about an inner rotor axis and has an external toothing. An outer rotor is rotatable in the housing about an outer rotor axis and has an internal toothing which, to generate a pump action, engages with the external toothing of the inner rotor. The internal-gear pump furthermore has a ring element which is mounted movably in the housing so as to be pivotable between a first position and a second position. At least a third fluid port is formed on the housing. The third fluid port is arranged relative to the
(Continued)

ring element such that, in the first position of the ring element, the third fluid port is connected to the second fluid port. In the second position, said third fluid port is separated from the second fluid port.

20 Claims, 4 Drawing Sheets

(51) Int. Cl.
*F04C 15/06* (2006.01)
*F04C 14/12* (2006.01)
*F04C 2/08* (2006.01)

(58) Field of Classification Search
USPC ..... 418/32, 61.3, 171; 417/213, 302
See application file for complete search history.

(56) References Cited

U.S. PATENT DOCUMENTS 4,748,362 A * 5/1988 Hedlund ..... H02K 1/246 310/162
5,547,349 A * 8/1996 Kimura ..... F01M 1/16 417/282
5,711,408 A * 1/1998 Dick ..... F04C 14/04 192/85.01
7,044,262 B2 * 5/2006 Otaki ..... B62D 5/062 180/422
8,444,401 B2 5/2013 Borst et al.
8,734,140 B2 5/2014 Wilton et al.
8,813,902 B2 * 8/2014 Sakamaki ..... B62D 5/065 180/422
9,068,456 B2 6/2015 Yarr
9,108,498 B2 8/2015 Schultz
2002/0149248 A1 10/2002 Jackson
2006/0007360 A1 1/2006 Kim
2007/0201989 A1 * 8/2007 Zhu ..... F04C 15/0049 417/310
2008/0083572 A1 4/2008 Ishida
2009/0196772 A1 * 8/2009 Watanabe ..... F04C 2/102 417/410.1
2011/0014078 A1 * 1/2011 Ono ..... F04C 2/086 418/166
2014/0009043 A1 * 1/2014 Watanabe ..... G01B 7/30 310/68 B

FOREIGN PATENT DOCUMENTS

CN 103101427 A 5/2013
DE 4231690 A1 3/1994
DE 10305585 B3 2/2004
DE 102011122642 A1 7/2012
EP 0330315 B1 1/1989

OTHER PUBLICATIONS

European Search Report dated Jan. 21, 2015, 6 pages.
European Search Report dated May 4, 2015, 13 pages.
English Translation of Chinese Office Action for Application No. 201410483216.8 dated Mar. 27, 2016, 9 pages.

* cited by examiner

INTERNAL-GEAR PUMP AND HYDRAULIC CIRCUIT FOR A MOTOR VEHICLE DRIVETRAIN

CROSS-REFERENCE TO RELATED APPLICATIONS

This application claims the priority of German patent application DE 10 2013 110 400.2, filed Sep. 20, 2013.

BACKGROUND

The present invention relates to an internal-gear pump, in particular for a hydraulic circuit of a motor vehicle drivetrain, having a housing which has a first fluid port and a second fluid port, having an inner rotor which is mounted in the housing so as to be rotatable about an inner rotor axis and which has an external toothing, and having an outer rotor which is rotatable in the housing about an outer rotor axis and which has an internal toothing which, to generate a pump action, engages with the external toothing of the inner rotor.

The invention also relates to a hydraulic circuit, in particular for a motor vehicle drivetrain, having an internal-gear pump of said type.

For hydraulic circuits of motor vehicle drivetrains, it is known to use hydraulic pumps in the form of gear pumps. With regard to gear pumps, a general distinction is made between external-gear pumps, internal-gear pumps and toothed-ring pumps. The expression "internal-gear pump" is in the present case intended to encompass the expression "toothed-ring pump". In both pump types, an inner rotor and an outer rotor run eccentrically with respect to one another. In the case of a toothed-ring pump, the internal toothing generally has precisely one tooth more than the external toothing. In other internal-gear pumps, the number of teeth on the internal toothing is considerably greater than that on the external toothing, wherein the teeth are sealed off by means of a sickle-shaped structure.

Such pumps are generally known. In hydraulic circuits of motor vehicle drivetrains such pumps may be electrically driven, specifically by means of an electric motor, which drives, for example, the inner rotor. Here, the pumps are used, for example, for generating a working pressure for a hydraulic actuator arrangement. A further use is that of supplying lubricating and/or cooling oil to clutch and transmission components.

In many applications, there are numerous components to which a supply is to be provided, which components should be supplied with specific volume flow rates of oil on an operation-dependent or strategy-dependent basis. Such components can each be regarded as hydraulic consumers. For example, one hydraulic consumer may be used for lubricating and/or cooling a dual-clutch gearbox, whereas another hydraulic consumer is formed by a cooling circuit of a drive motor, which may for example be in the form of an electric machine for providing drive power for the motor vehicle.

For a volume flow of hydraulic fluid provided by a pump of said type to be distributed between two or more such hydraulic consumers, it is known to connect a pressure outlet of a pump of said type to a valve, in particular a directional valve. Said directional valve is then generally activated by means of a superordinate control unit. In implementing this variant, it is a problem that, for the electrical actuation of the valve, lines must be laid from a central controller, which is often arranged outside a transmission or clutch housing, to a region of the pump, which is generally arranged in the interior of the housing.

A further option for providing a supply to two hydraulic consumers by means of one pump consists in designing the pump to exhibit bidirectional characteristics. Depending on the direction of rotation, one of the two fluid ports of the pump is then a pressure port, and the respective other is then a suction port. Since it is generally also the case here that fluid must be delivered out of a sump, it is then necessary, by means of a complex check valve arrangement which comprises four check valves, for example, to ensure that, in each direction of rotation, fluid is drawn out of the fluid sump and discharged via the respective pressure port.

SUMMARY

Against this background, it is an object of the invention to specify an improved internal-gear pump and an improved hydraulic circuit, wherein in particular, it is possible for more than one hydraulic consumer to be supplied with fluid by means of only one such pump.

Said object is achieved, in the case of the internal-gear pump mentioned in the introduction, in that said internal-gear pump furthermore has a ring element which is mounted movably in the housing and which is pivotable between a first position and a second position, wherein at least one third fluid port is formed on the housing, wherein the third fluid port is arranged relative to the ring element such that, in the first position of the ring element, the third fluid port is connected to the second fluid port, and in the second position, said third fluid port is separated from the second fluid port.

The above object is furthermore achieved by means of a hydraulic circuit having an internal-gear pump according to the invention or having an internal-gear pump mentioned in the introduction.

In the present case, the expression "internal-gear pump" is intended to encompass both internal-gear pumps and also toothed-ring pumps (or gerotor pumps). The present application relates in particular to toothed-ring pumps.

In any case, the inner rotor axis and the outer rotor axis are eccentrically offset. The inner rotor (or the outer rotor) is driven, specifically preferably by means of an electric motor which is assigned directly to the pump and which consequently does not serve for providing drive power for a motor vehicle.

The first fluid port may for example be connected to a tank or to a reservoir for hydraulic fluid. The second fluid port may for example be in the form of a pressure port.

In the field of gerotor pumps, it is known for the outer rotor to be mounted in a ring element which is pivotable or rotatable in the housing between two positions. A rotor pump of said type is known for example from document DE 10 2011 122 642 A1, U.S. Pat. No. 8,444,401. Here, the ring element is in the form of an offset ring or diverting ring. Owing to the rotatability or pivotability of said ring element within the housing, the outer rotor axis can be displaced, whereby, in general, the delivery direction of the pump changes. Here, the offset ring is designed so as to change its rotational position as a function of the drive direction of the driven rotor element. In this way, it is possible to realize a delivery direction that remains the same in the case of changing direction of rotation of the driven rotor element.

A similar type of internal-gear pump is known from document EP 0 330 315 B1. Here, a ring element of said type, within which an outer rotor is rotatably mounted, is mounted within a housing cavity so as to be pivotable between two positions, specifically about a pin which is arranged eccentrically with respect to a central axis of rotation.

While it is generally known from the prior art to integrate a ring element into an internal-gear pump of said type, the present invention proposes that said ring element be used as a type of valve slide which, in one position, connects a further fluid port to the second fluid port and which, in a second position of the ring element, separates the third fluid port from the second fluid port.

In this embodiment, it is consequently possible, by changing the direction of rotation of the internal-gear pump, to set whether for example only the second fluid port is in the form of a pressure port or both the second and third fluid ports are in the form of pressure ports.

This leads to increased versatility of the internal-gear pump, such that the hydraulic circuit can be realized with a small number of simple components.

The object is thus achieved in its entirety.

In a particularly preferred embodiment of the internal-gear pump, at least one fourth fluid port is formed on the housing, wherein the fourth fluid port is arranged relative to the ring element such that, in the second position of the ring element, the fourth fluid port is connected to the second fluid port and, in the first position of the ring element, said fourth fluid port is separated from the second fluid port.

In said variant, it is consequently provided that, depending on the position of the ring element, either the third or the fourth fluid port is connected to the second fluid port. In this way, the internal-gear pump can be used in a hydraulic circuit in a versatile manner.

It is generally conceivable for the ring element to be pivoted within the housing about an axis which is eccentric with respect to the inner rotor axis.

It is however particularly preferable if the ring element is mounted in the housing so as to be rotatable about a ring element axis between a first rotational position and a second rotational position and has a rotor receptacle for rotatably receiving the outer rotor, wherein the rotor receptacle is formed eccentrically with respect to the ring element axis.

Here, the ring element axis is preferably the same as the inner rotor axis.

Furthermore, it is particularly advantageous if the first fluid port is in the form of a suction port regardless of the rotational direction of the inner rotor, and if the second fluid port is in the form of a pressure port regardless of the rotational direction of the inner rotor.

In the case of the hydraulic circuit according to the invention, in one variant, it is preferable if the third fluid port and/or the fourth fluid port is connected to a consumer section of the hydraulic circuit.

By means of said measure, it is for example possible, in one variant, for a hydraulic consumer section to be permanently supplied with pressurized hydraulic fluid via the second fluid port. Furthermore, a hydraulic consumer connected to the third fluid port can be supplied with pressurized hydraulic fluid in a manner dependent on the direction of rotation of the driven ring element. If appropriate, a further hydraulic consumer section may be provided with a supply via the fourth fluid port in a manner dependent on the direction of rotation.

In a further variant, the hydraulic circuit comprises a valve which is connected to the first or to the second fluid port of the internal-gear pump, wherein the valve can be actuated as a function of the position of the ring element or as a function of a rotational direction of the inner rotor.

In this embodiment, it is particularly advantageous that a valve of said type can be arranged in spatial proximity to the pump and/or within a drivetrain housing, and that the valve preferably does not need to be actuated by a central control device via a control line. Accordingly, it is possible to realize a switchover of a volume flow of hydraulic fluid according to demand with a minimum number of components, and to do so with a small space requirement and with low component and assembly costs.

In a preferred embodiment, the valve can in this case be actuated by means of a directly or indirectly acting actuating device, and wherein the actuating device is connected to the third fluid port and/or to the fourth fluid port.

If the valve is preloaded in an actuating direction by means of a spring, it is adequate for the actuating device to be connected to one out of the third and fourth fluid ports. Alternatively, the valve may be equipped with actuating devices that act in opposite directions, wherein one actuating device is connected to the third fluid port and the other actuating device is connected to the fourth fluid port.

In a further preferred embodiment, the valve can be actuated by means of an electrical actuating device, wherein the internal-gear pump is assigned a rotational position sensor arrangement which detects the rotational position of the ring element and outputs a rotational position signal, and wherein the electrical actuating device is activated on the basis of the rotational position signal.

In the case of this type of hydraulic circuit, too, the valve can be actuated by means which are arranged in the direct vicinity of or in direct proximity to the internal-gear pump.

In one variant, the rotational position sensor arrangement may in this case be connected to a switch, for example a switch relay. In one alternative, the rotational position sensor arrangement comprises an amplifier in order to activate the electrical actuating device on the basis of a signal amplified in this way.

In a further preferred embodiment, the valve can be actuated by means of an electric actuating device, wherein the hydraulic circuit has an electric motor which drives the inner rotor, wherein the motor is assigned a rotational direction sensor arrangement which detects the direction of rotation of the motor and outputs a rotational direction signal, and wherein the electrical actuating device is activated on the basis of the rotational direction signal.

Here, too, the switchover of the volume flow can be performed by means lich are arranged in close proximity to the internal-gear pump.

In one embodiment, the rotational direction sensor arrangement is designed to detect the rotational direction of the motor on the basis of a commutation sequence of electrical connection phases of the motor.

In a further preferred embodiment, the rotational direction sensor arrangement is designed to detect the rotational direction of the motor on the basis of signals from a position encoder system of the motor.

Overall, with the present invention, it is possible to obtain at least one of the following advantages, depending on the embodiment.

The internal-gear pump can deliver a delivered volume flow in two different branches of a hydraulic circuit in a manner dependent on the direction of rotation of the pump or of the motor (in particular electric motor) driving the pump. Here, it is preferably the case that no separate element and/or no separate activation means (electrical current outlet on a central control unit) is required for the switchover of the delivery flow.

It is accordingly possible to realize a switchover without providing a separate switchover channel in a central electrical control unit. Furthermore, it is not necessary for a complex passive hydraulic switchover system, with check valves and with a correspondingly large space requirement, to be provided.

A switchover of the volume flow according to demand can preferably be realized with a minimal number of components, with a resulting small space requirement, and with low component and assembly costs.

The internal-gear pump is preferably an internal-gear pump without sickle-shaped structure (for example gerotor pump), in which the outer rotor runs not directly in the housing but in a reversing ring which assumes two different angular positions (rotational positions) depending on the rotational direction of the pump drive. The reversing ring (ring element) provides the necessary eccentricity of the outer rotor with respect to the inner rotor (or preferably the electric motor axis) and, in the event of a change in rotational direction of the inner rotor, is driven along by the outer rotor preferably by fluid friction until said reversing ring preferably impacts against a stop.

The basic mode of operation of a reversing ring is known from the prior art as cited above, wherein a pump can change its delivery direction in the presence of an unchanged rotational direction, or else can maintain the same delivery direction despite a reversal of the rotational direction.

In the case of the present invention, a reversing ring of said type is preferably utilized directly or indirectly as a slide element in order to conduct the delivered volume flow of hydraulic fluid differently.

In one embodiment, the volume flow may be supplied at a part of the housing which is in each case only partially covered by the reversing ring, whereas a semiring-shaped duct situated around the reversing ring opens up in each case one duct opening.

In a further design variant, the pump delivery volume flow may be supplied at two spatially separate sections, wherein then, in each operating rotational direction, one of said sections is completely closed by the reversing ring that acts as control slide.

In one alternative, it may also be provided that the reversing ring is used for switching merely a control volume flow, which then reverses a hydraulically actuated valve slide.

If a rotational position sensor is provided which detects the respective rotational position of the ring element (reversing ring), an electrical switchover valve can be activated by means of a sensor of said type. In the case of this activation variant, too, there is then no need for a separate output for the switchover valve on a central control unit. A sensor of said type may in this case react passively to a magnetic field; it may, as a magnetically biased active magnetic field sensor, react to the presence of the reversing ring. Capacitive, resistive or optical sensor systems are also conceivable in principle.

It is generally advantageous that a simple mechanical construction is realized which, with few components and in a small structural space, realizes a simple switchover of a volume flow, which can preferably be varied in continuous fashion by the electric motor, between two paths. Since there is no need for a switching output for a solenoid valve to be provided in a central control unit (transmission control unit), it is possible to realize a switchover facility for the delivered volume flow without any modification to transmission controller hardware. A valve of said type can be located in the transmission at virtually any desired location, even at a position remote from the pump. In this way, the critical structural space/packaging situation in the region of the pumps is alleviated.

Furthermore, the reliability with which the useful volume flow is switched over by a reversal of a switching valve can be increased overall by means of hydraulic pilot control or an electrical signal.

In the variants in which a sensor is used for detecting the rotational direction or for detecting a rotational position, an electrical circuit used for this purpose may be part of a transmission control unit, part of the electric motor, part of the switching valve or part of the electrical wiring loom which, for example, supplies activation signals and energy to the electric motor.

It is self-evident that the features mentioned above and the features yet to be explained below can be used not only in the respectively specified combination but also in other combinations or individually without departing from the scope of the present invention.

BRIEF DESCRIPTION OF THE SEVERAL VIEWS OF THE DRAWING

Exemplary embodiments of the invention are illustrated in the drawing and will be explained in more detail in the description below, in which.

PREFERRED EMBODIMENTS

Figure 1:
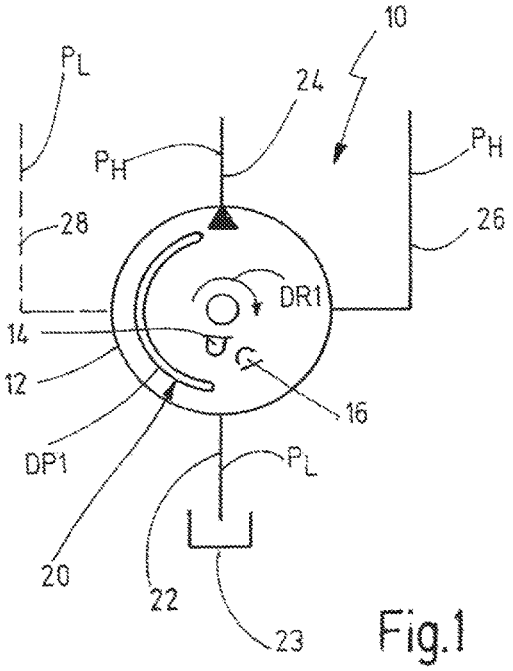
FIG. 1 is a schematic illustration of an internal-gear pump with a ring element in a first rotational position.

FIG. 1 schematically illustrates an internal-gear pump 10. The internal-gear pump 10 comprises a housing 12 with a schematically indicated inner rotor 14 and a schematically indicated outer rotor 16. The internal-gear pump 10 is preferably in the form of a toothed-ring pump or gerotor pump, such that an internal toothing (not illustrated in any more detail) of the outer rotor 16 has one tooth more than the external toothing of the inner rotor 14. A pump action is realized by meshing of the toothings. It is preferably the case that the inner rotor 14 is driven, in particular by means of an electric motor. A ring element 20 is mounted, in the manner of a reversing ring, in the housing 12. The ring element 20 is pivotable concentrically with respect to an axis of the inner rotor 14 between two rotational positions, one of which is illustrated in FIG. 1 at DP1. The ring element 20 furthermore has an outer rotor receptacle (not shown in any more detail) which is formed eccentrically with respect to the inner rotor axis.

On the housing 12 there is formed a first fluid port 22, which is preferably in the form of a suction port and connected to a tank 23. Furthermore, the housing 12 has a second fluid port 24, which is preferably in the form of a pressure port. In FIG. 1, the internal-gear pump 10 is driven in a first direction of rotation DR1. The pressure level at the first fluid port 22 is denoted by $P_L$. The pressure level at the second fluid port 24 is denoted by $P_H$, wherein $P_H > P_L$.

In the illustrated rotational position DP1 of the ring element 20, a third fluid port 26 of the housing 12 is connected to the second fluid port 24, such that a pressure level $P_H$ likewise prevails at said second fluid port. The housing 12 optionally has a fourth fluid port 28 which, in the illustrated rotational position DP1 of the ring element 20, is not connected to the second fluid port 24, such that, at said fourth fluid port, a pressure level $P_L$ prevails which however need not imperatively be equal to the pressure level $P_L$ in the first fluid port 22.

Figure 2:
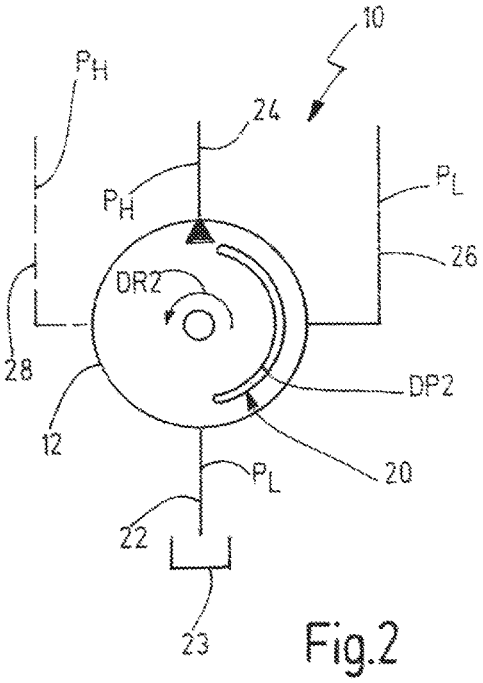
FIG. 2 shows the internal-gear pump from FIG. 1 with the ring element in a second rotational position.

FIG. 2 shows the internal-gear pump 10 of FIG. 1, wherein the ring element 20 is situated in the second rotational position DP2. Furthermore, the inner rotor 14 is being driven in an opposite rotational direction DR2. In this case, as before, a pressure level $P_L$ prevails at the first fluid port 22, and a pressure level $P_H$ prevails at the second fluid port 24. The third fluid port 26 is separated from the second fluid port 24 by the ring element 20, such that a pressure level $P_L$ prevails at said third fluid port. If a fourth fluid port 28 is provided, the latter is preferably connected to the second fluid port 24 in the second rotational position DP2 of the ring element 20, such that a pressure level $P_H$ prevails at said fourth fluid port.

Figure 3:
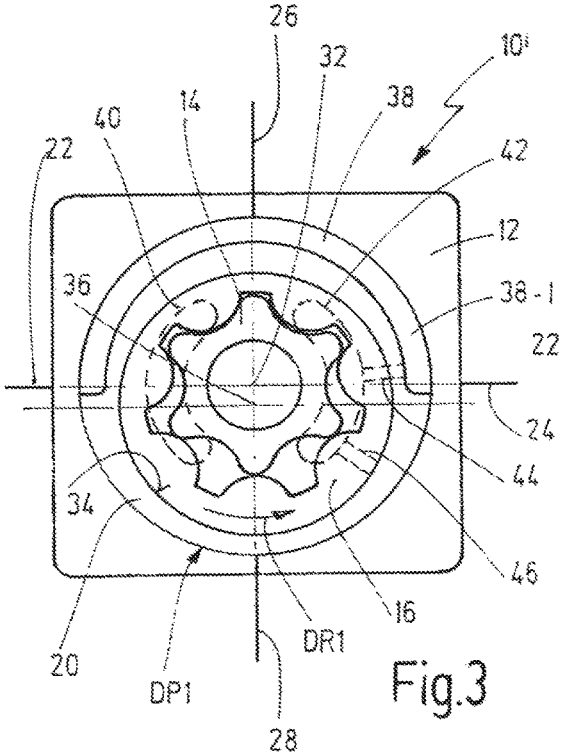
FIG. 3 shows a schematic cross-sectional view of an internal-gear pump according to an embodiment of the invention, specifically with a ring element in a first rotational position.
Figure 4:
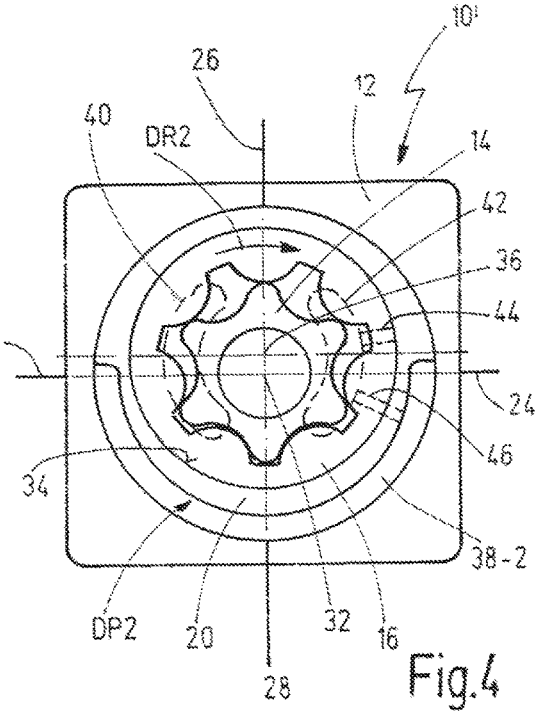
FIG. 4 shows the internal gear wheel pump of FIG. 3 with the ring element in a second rotational position.

FIGS. 3 and 4 illustrate an internal-gear pump 10' which generally corresponds in terms of design and mode of operation to the internal-gear pump 10 of FIG. 1. Identical elements are denoted by the same reference signs.

It can be seen that an inner rotor 14 is mounted on the housing 12 so as to be rotatable about an inner rotor axis 32. The ring element 20 has a rotor receptacle 34 which is formed eccentrically in relation to the inner rotor axis 32. The outer rotor 16 is received within, and rotatably mounted in, the rotor receptacle 34. The outer rotor axis 36 is, owing to the eccentricity of the rotor receptacle 34, arranged eccentrically in relation to the inner rotor axis 32. In the first rotational position DP1 of the ring element 20 as shown in FIG. 3, said ring element forms, between an outer circumferential section of the ring element 20 and an inner circumferential section of the housing 12 within which the ring element 20 is rotatably mounted, an annular chamber 38 which, in the present case, extends over an angle range of approximately 180°.

The illustration in FIG. 3 also shows that the internal-gear pump 10 has, in a manner known per se, a kidney-shaped suction port 40 which is connected to the first fluid port 22. Furthermore, the fluid pump 10' of FIG. 3 has a kidney-shaped pressure port 42 which is connected, in a manner known per se, to the second fluid port 24.

Also illustrated in the housing 12 is a schematically illustrated first connection 44 between the kidney-shaped pressure port 42 and the annular chamber 38 illustrated in FIG. 3, wherein the annular chamber 38 is denoted in FIG. 3 by 38-1 and, in the present case, is connected to the third fluid port 26.

The internal-gear pump 10' furthermore comprises a second connection 46 between the kidney-shaped pressure port 42 and another inner circumferential section of the housing 12, which in the present case is covered by the ring element 20. The ring element 20 consequently acts as a control slide which, in the first rotational position DP1 shown in FIG. 3, connects the second fluid port 24 to the third fluid port 26.

FIG. 4 shows the internal-gear pump 10' of FIG. 3, wherein the ring element 20 is situated in the second rotational position DP2. Here, the ring element 20 now overlaps the first connection 44, whereas the kidney-shaped pressure port 42 is connected via the second connection 46 to the annular chamber now denoted by 38-2', and consequently to the fourth fluid port 28.

The connections 44, 46 shown in the illustrations are merely of a schematic nature and are intended to indicate that, depending on the rotational position of the ring element 20, either the third fluid port 26 or the fourth fluid port 28 is connected to the second fluid port 24, such that the functionality illustrated in FIGS. 1 and 2 is realized.

Figure 5:
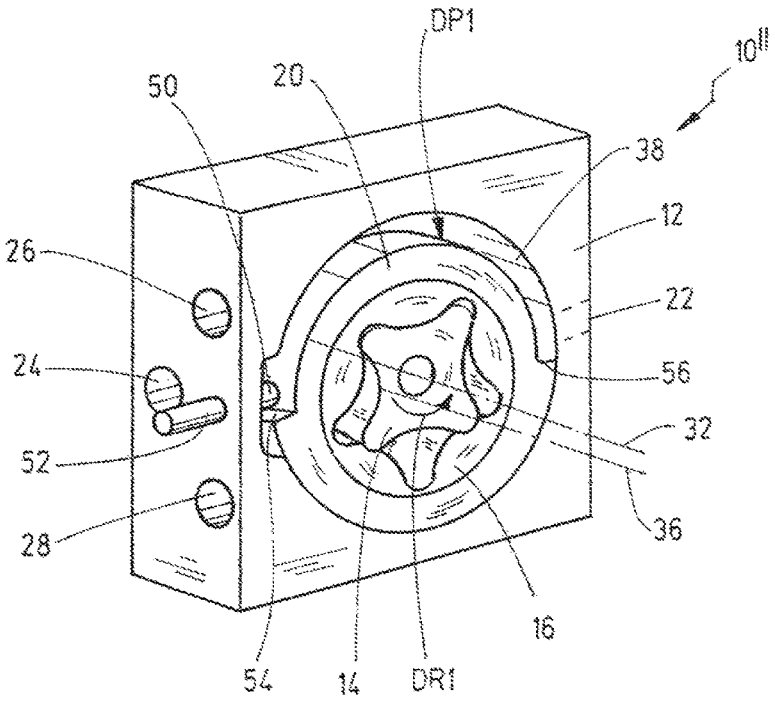
FIG. 5 shows a schematic, perspective view of a further embodiment of an internal-gear pump according to the invention, with a ring element in a first rotational position.

FIG. 5 shows a further embodiment of an internal-gear pump 10" which generally corresponds in terms of design and mode of operation to the internal gear wheel pump 10' of FIGS. 3 and 4. Identical elements are therefore denoted by the same reference signs. Primarily the differences will be explained below.

Accordingly, the housing 12 of the internal-gear pump 10" has a stop 50 by means of which the ring element 20 can be held in the respective rotational positions DP1, DP2 (DP1 is shown in FIG. 5). In the present case, for simplicity, the stop 50 is formed by a pin 52 which extends through a wall of the housing 12 and which, depending on the rotational position, engages on a first shoulder 54 or on a second shoulder 56 of the ring element 20. The shoulders 54, 56 enclose the annular chamber 38 between them in the circumferential direction.

FIG. 5 also shows that the third fluid port 26 and the fourth fluid port 28 may be formed on a common outer surface of the housing 12, and preferably on an outer surface on which the second fluid port 24 is also formed. The first fluid port 22 is formed on the axially opposite side and is merely schematically indicated in FIG. 5.

Figure 6:
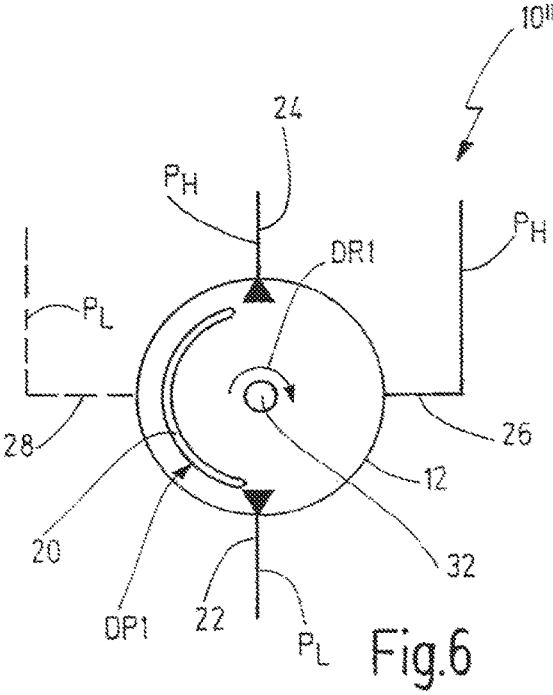
FIG. 6 is a schematic illustration of an internal-gear pump according to an embodiment of the invention, wherein a ring element is mounted so as to be rotatable concentrically with respect to the axis of rotation of an inner rotor and is illustrated in a first rotational position.
Figure 7:
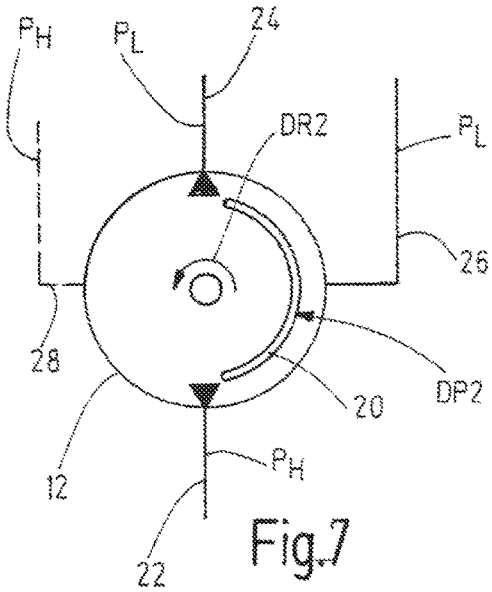
FIG. 7 shows the internal-gear pump from FIG. 6 with the ring element in a second rotational position.

FIGS. 6 and 7 show an alternative embodiment of an internal-gear pump 10''' which generally corresponds in terms of design and mode of operation to the internal-gear pump 10 of FIGS. 1 and 2. Identical elements are therefore denoted by the same reference signs. Primarily the differences will be explained below.

In the case of the internal-gear pump 10''' of FIGS. 6 and 7, the ring element 20 is formed not as a reversing ring but merely as a control slide. Consequently, in one direction of rotation DR1, the first fluid port 22 is in the form of a suction port and the second fluid port 24 is in the form of a pressure port, whereas in the second direction of rotation DR2 (FIG. 7), the second fluid port 24 is in the form of a suction port and the first fluid port 22 is in the form of a pressure port. As a result of the ring element 20 being designed as a control slide, it is the case that, in the first rotational position DP1 of the ring element 20, the third fluid port 26 is connected to the second fluid port 24, whereas, in the second rotational position DP2, the fourth fluid port 28 is connected to the first fluid port 22, which than acts as pressure port. Since, in this embodiment, the ring element 20 acts merely as a control slide and not as a reversing ring, it is however possible to freely select, within broad limits, which fluid port the third and fourth fluid ports 26, 28 are connected to in the respective rotational positions DP1, DP2. Alternatively, in the configuration of FIG. 6, it would also be possible for the third fluid port 26 to be connected to the first fluid port 22, and for the fourth fluid port 28 to be connected to the second fluid port 24, such that a correspondingly reversed fluid port connection is realized in FIG. 7.

Figure 8:
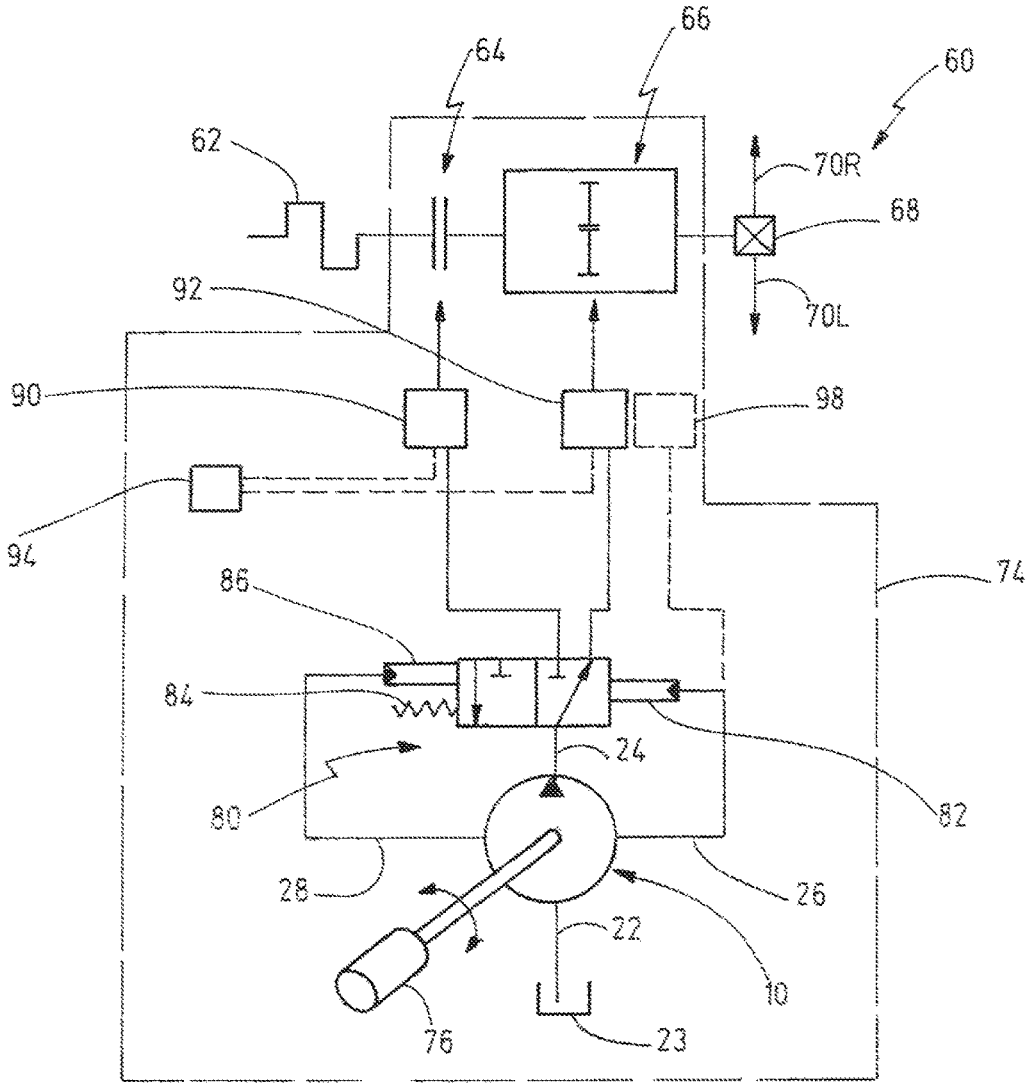
FIG. 8 shows a motor vehicle drivetrain having a hydraulic circuit according to the invention in schematic form.

In FIG. 8, a drivetrain for a motor vehicle is illustrated in schematic form and denoted generally by 60. The drivetrain 60 comprises a drive motor 62. The drive motor 62 may be an internal combustion engine, but may also be an electric drive motor for providing drive power. The drivetrain 60 also comprises a clutch arrangement 64, which may be a single clutch or a dual-clutch arrangement. Furthermore, the drivetrain 60 comprises a transmission arrangement 66, which may comprise a single-stage or multi-stage transmission, and a transmission without or with gearshift capability. In the case of a transmission with gearshift capability, the transmission arrangement 66 may be a dual-clutch transmission. Filially, the drivetrain 60 comprises a differential 68 by means of which drive power can be distributed between two driven wheels 70L, 70R of the motor vehicle.

The drivetrain 60 also comprises a hydraulic circuit 74. In the hydraulic circuit 74, there is provided an internal-gear pump 10 which, in terms of functionality, is preferably designed in the manner of one of the internal-gear pumps 10, 10', 10" of FIGS. 1 to 5. The internal-gear pump 10 is driven by means of an electric motor 76, wherein the electric motor 76 can be activated in both rotational directions, as schematically indicated in FIG. 8 by a double arrow.

The second fluid port 24 and the third fluid port 26, and if appropriate a fourth fluid port 28, of the internal-gear pump 10 may be connected directly to hydraulic consumer sections, as will be explained below.

In the present case, however, the hydraulic circuit 74 comprises a valve 80, which in the present case is in the form of a 3/2 directional valve. The valve 80 comprises a first hydraulic actuating device 82 for moving the valve 80 into a first switching position. Furthermore, the valve 80 may have a restoring spring 84 which counteracts the first hydraulic actuating device 82. The first hydraulic actuating device 82 may for example be connected to the third fluid port 26.

It is furthermore possible for the valve 80 to have a second hydraulic actuating device 86. In this case, the second hydraulic actuating device 86 is preferably connected to the fourth fluid port 28.

An inlet of the valve 80 is connected to the second fluid port 24. A first outlet of the valve 80 is connected to a first hydraulic consumer section 90, which may for example be assigned to the clutch arrangement 64. A second outlet of the valve 80 is, in the present case, connected to a second hydraulic consumer section 92, which may for example be assigned to the transmission arrangement 66 or to the drive motor 62.

In some embodiments of the hydraulic circuit 74, a central control device 94 (transmission control unit) is provided which actuates the consumer sections 90, 92.

As schematically indicated in FIG. 8, the third fluid port 26 may also be directly connected to a consumer section, as shown in the present case by a third hydraulic consumer section 98.

Furthermore, the second and/or the fourth fluid port 24 may also be directly connected to a hydraulic consumer section of said type.

The consumer sections are generally designed for supplying fluid to certain components of the drivetrain 60. The consumer sections may each comprise actuator devices for actuating certain components of the drivetrain 60, such as, for example, clutches of the clutch arrangement 64 and/or gearshift clutches of the transmission arrangement 66. Furthermore, the consumer sections may in each case alternatively or additionally be purely in the form of lubricating and/or cooling sections.

Figure 9:
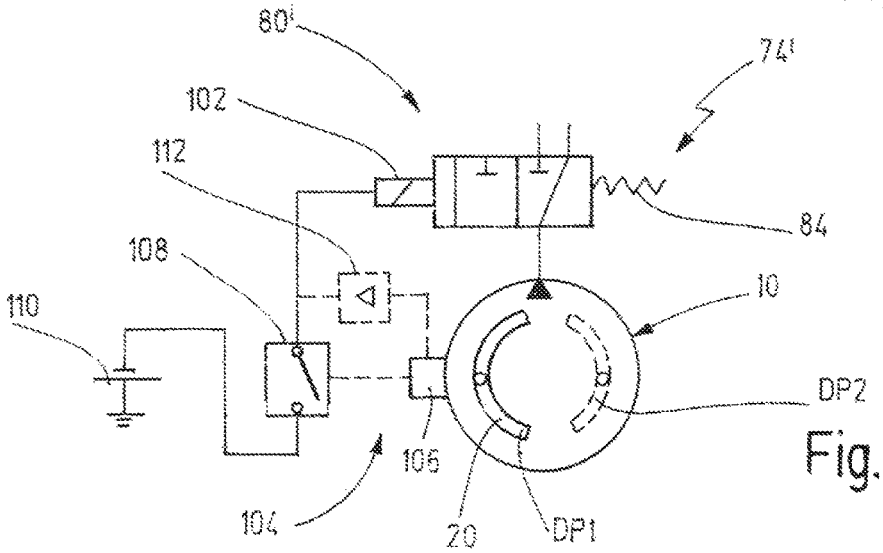
FIG. 9 shows a further embodiment of a hydraulic circuit according to the invention.
Figure 10:
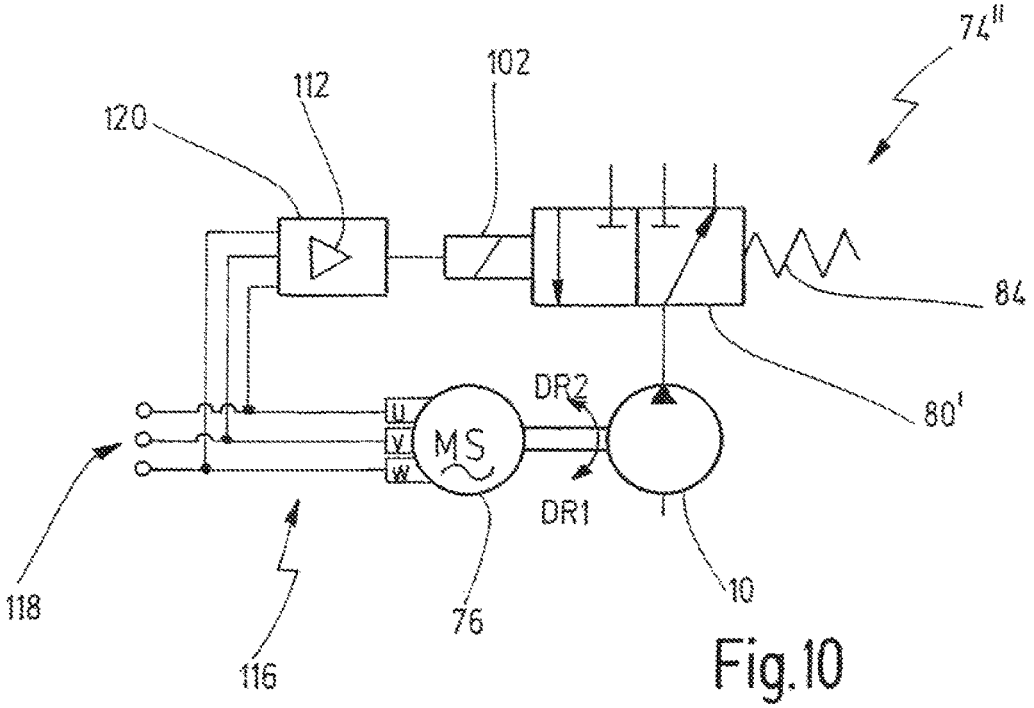
FIG. 10 shows a further embodiment of a hydraulic circuit according to the invention.
Figure 11:
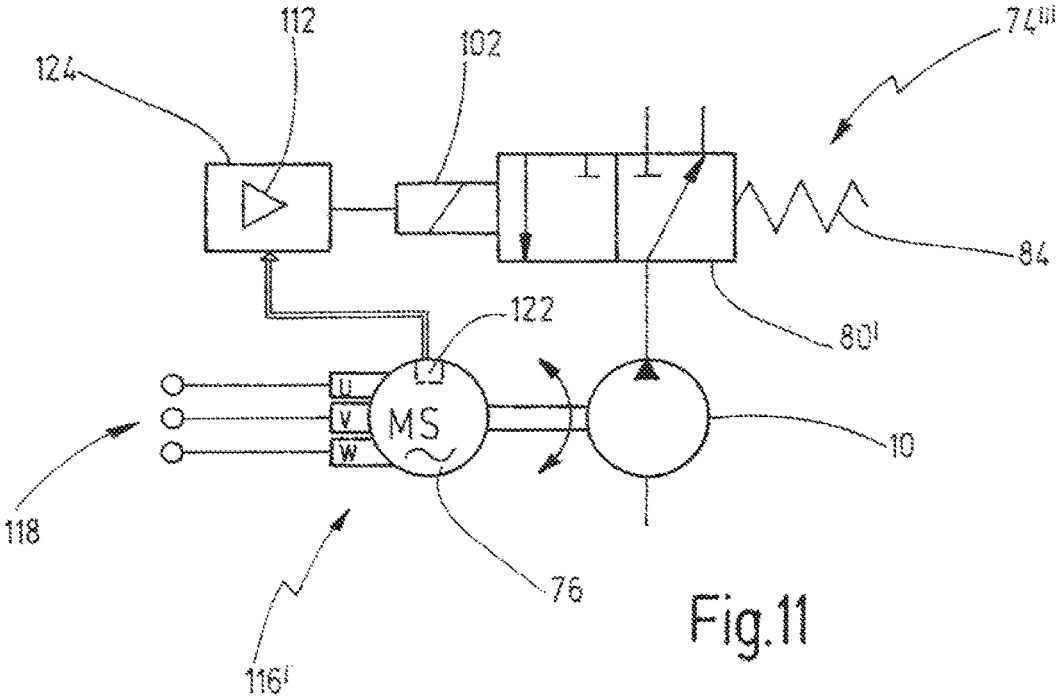
FIG. 11 shows a further embodiment of a hydraulic circuit according to the invention.

FIGS. 9 to 11 show further embodiments of hydraulic circuits, which may generally correspond in terms of design and mode of operation to the hydraulic circuit 74 of FIG. 8. Identical elements are therefore denoted by the same reference signs. Primarily the differences will be explained below.

In the case of the hydraulic circuit 74' of FIG. 9, a valve 80' has an electrical actuating device 102, wherein the valve 80' is preloaded by means of a restoring spring 84. Furthermore, in the present case, the hydraulic circuit 74' comprises a rotational position sensor arrangement 104 which comprises a rotational position sensor 106 which can detect the rotational position DP of the ring element 20 of the pump 10, for example by inductive, optical, capacitive, resistive or other means.

In the present case, the rotational position sensor arrangement 104 furthermore comprises a switch 108 which connects a voltage source 110 to the electrical actuating device 102. The switch 108 can be actuated by means of a signal from the rotational position sensor 106.

In one variant, the rotational position sensor 106 may also be connected to an amplifier 112 in order to activate the electrical actuating device 102 even without a switch 108.

In the variant 74" shown in FIG. 10, the same valve 80' is provided, wherein a rotational direction sensor arrangement 116 is provided which detects the rotational direction of the pump 10 or of the electric motor 76. In the present case, the rotational direction DR of the electric motor 76 is detected by means of a sensor 120 which detects the commutation sequence of connection phases 118 of the electric motor 76 and derives the direction of rotation therefrom. A rotational direction signal derived therefrom is amplified by means of an amplifier 112 and is used for activating the electrical actuating device 102.

FIG. 11 shows a modification of the embodiment of FIG. 10, wherein a hydraulic circuit 74''' has an electric motor 76 which comprises a position encoder system 122 by means of which the rotational position and/or rotational direction of the electric motor 76 can be detected. In the present case, the position encoder system 122 is connected to a sensor 124, which detects the rotational direction DR and which may comprise an amplifier 112 by means of which the electrical actuating device 102 can be directly activated.

The invention claimed is:

1. An internal-gear pump, having a housing which has a first fluid port and a second fluid port, an inner rotor which is mounted in the housing so as to be rotatable about an inner rotor axis and which has an external toothing, and an outer rotor which is rotatable in the housing about an outer rotor axis and which has an internal toothing which, to generate a pump action, engages with the external toothing of the inner rotor, and a ring element which is mounted movably in the housing so as to be rotatable about a ring element axis between a first position and a second position and which has a rotor receptacle for rotatably receiving the outer rotor, wherein the rotor receptacle is formed eccentrically with respect to the ring element, wherein at least a third fluid port is formed on the housing, and wherein the third fluid port is arranged relative to the ring element such that, in the first position of the ring element, the third fluid port is connected to the second fluid port, and in the second position, said third fluid port is disconnected from the second fluid port; and wherein the ring element provides eccentricity of the outer rotor with respect to the inner rotor, such that, in the event of a change in a rotational direction of the inner rotor, the ring element is driven along by the outer rotor by a fluid friction, so as to establish either the first position of the ring element or the second position of the ring element depending on the direction of rotation of the inner rotor.

2. The internal-gear pump according to claim 1, wherein at least a fourth fluid port is formed on the housing, wherein the fourth fluid port is arranged relative to the ring element such that, in the second position of the ring element, the fourth fluid port is connected to the second fluid port and, in the first position, said fourth fluid port is separated from the second fluid port.

3. The internal-gear pump according to claim 1, wherein the first position of the ring element is displaced from the second position by 180 degrees.

4. The internal-gear pump according to claim 1, wherein the first fluid port is in the form of a suction port regardless of the rotational direction of the inner rotor, and the second fluid port is in the form of a pressure port regardless of the rotational direction of the inner rotor.

5. A hydraulic circuit comprising an internal-gear pump, the internal-gear pump having a housing which has a first fluid port and a second fluid port, an inner rotor which is mounted in the housing so as to be rotatable about an inner rotor axis and which has an external toothing, and an outer rotor which is rotatable in the housing about an outer rotor axis and which has an internal toothing which, to generate a pump action, engages with the external toothing of the inner rotor, and a ring element which is mounted movably in the housing and which is pivotable between a first position and a second position, wherein the ring element provides eccentricity of the outer rotor with respect to the inner rotor, such that, in the event of a change in a rotational direction of the inner rotor, the ring element is driven along by the outer rotor by a fluid friction, so as to establish either the first position of the ring element or the second position of the ring element depending on the direction of rotation of the inner rotor, wherein at least a third fluid port is formed on the housing, wherein the third fluid port is arranged relative to the ring element such that, in the first position of the ring element, the third fluid port is connected to the second fluid port, and in the second position, said third fluid port is disconnected from the second fluid port, such that the ring element is a valve slide element of the hydraulic circuit.

6. The hydraulic circuit according to claim 5, wherein at least one of the third fluid port and a fourth fluid port is connected to a consumer section of the hydraulic circuit.

7. The hydraulic circuit according to claim 5, having a valve which is connected to the first fluid port or to the second fluid port of the internal-gear pump, wherein the valve is configured to be actuated as a function of the position of the ring element or is configured to be actuated as a function of a rotational direction of the inner rotor.

8. The hydraulic circuit according to claim 7, wherein the valve is configured to be actuated by means of a directly or indirectly acting actuating device, and wherein the directly or indirectly acting actuating device is connected to at least one of the third fluid port and a fourth fluid port.

9. The hydraulic circuit according to claim 7, wherein the valve is configured to be actuated by means of an electrical actuating device, wherein the internal-gear pump is assigned a rotational position sensor arrangement which detects the rotational position of the ring element and outputs a rotational position signal, and wherein the electrical actuating device is activated on the basis of the rotational position signal.

10. The hydraulic circuit according to claim 7, wherein the valve is configured to be actuated by means of an electric actuating device, wherein the hydraulic circuit has an electric motor which drives the inner rotor, wherein the motor is assigned a rotational direction sensor arrangement which detects a direction of rotation of the motor and outputs a rotational direction signal, and wherein the electrical actuating device is activated on the basis of the rotational direction signal.

11. The hydraulic circuit according to claim 10, wherein the rotational direction sensor arrangement is designed to detect the rotational direction of the motor on a basis of a commutation sequence of electrical connection phases of the motor.

12. The hydraulic circuit according to claim 10, wherein the rotational direction sensor arrangement is designed to detect the rotational direction of the motor on a basis of signals from a position encoder system of the motor.

13. A hydraulic circuit which comprises an internal-gear pump, having a housing which has a first fluid port and a second fluid port, an inner rotor which is mounted in the housing so as to be rotatable about an inner rotor axis and which has an external toothing, and an outer rotor which is rotatable in the housing about an outer rotor axis and which has an internal toothing which, to generate a pump action, engages with the external toothing of the inner rotor, a ring element which is mounted movably in the housing and which is pivotable between a first position and a second position, and a valve which is connected to the first fluid port or to the second fluid port of the internal-gear pump, wherein at least a third fluid port is formed on the housing, and wherein the third fluid port is arranged relative to the ring element such that, in the first position of the ring element, the third fluid port is connected to the second fluid port, and in the second position, the third fluid port is disconnected from the second fluid port; and wherein the ring element provides eccentricity of the outer rotor with respect to the inner rotor, such that, in the event of a change in a rotational direction of the inner rotor, the ring element is driven along by the outer rotor by a fluid friction, so as to establish either the first position of the ring element or the second position of the ring element depending on the direction of rotation of the inner rotor.

14. The hydraulic circuit according to claim 13, wherein the valve is configured to be actuated as a function of a rotational direction of the inner rotor.

15. The hydraulic circuit according to claim 13, wherein the valve is configured to be actuated by means of a directly or indirectly acting actuating device, and wherein the actuating device is connected to at least one of a third fluid port and a fourth fluid port.

16. The hydraulic circuit according to claim 13, wherein the valve is configured to be actuated by means of an electrical actuating device, wherein the internal-gear pump is assigned a rotational position sensor arrangement which detects a rotational position of the ring element and outputs a rotational position signal indicative of the rotational position of the ring element, and wherein the electrical actuating device is activated on the basis of the rotational position signal.

17. The hydraulic circuit according to claim 13, wherein the valve is configured to be actuated as a function of a position of the ring element.

18. The hydraulic circuit according to claim 13, wherein the valve is configured to be actuated by means of an electric actuating device, wherein the hydraulic circuit has an electric motor which drives the inner rotor, wherein the motor is assigned a rotational direction sensor arrangement which detects a direction of rotation of the motor and outputs a rotational direction signal indicative of the direction of rotation of the motor, and wherein the electrical actuating device is activated on the basis of the rotational direction signal.

19. The hydraulic circuit according to claim 18, wherein the rotational direction sensor arrangement is designed to detect the rotational direction of the motor on a basis of a commutation sequence of electrical connection phases of the motor.

20. The hydraulic circuit according to claim 18, wherein the rotational direction sensor arrangement is designed to detect the rotational direction of the motor on a basis of signals from a position encoder system of the motor.

* * * * *